US006015270A

United States Patent [19]

Roth

[11] Patent Number: 6,015,270

[45] Date of Patent: Jan. 18, 2000

[54] LINEAR COMPRESSOR OR PUMP WITH INTEGRAL MOTOR

[75] Inventor: Bruce A. Roth, Chandler, Ariz.

[73] Assignee: Air Conditioning Technologies, Mesa, Ariz.

[21] Appl. No.: 08/834,371

[22] Filed: Apr. 16, 1997

Related U.S. Application Data

[60] Provisional application No. 60/017,006, Apr. 30, 1996.

[51] Int. Cl.[7] ..... F04B 3/00

[52] U.S. Cl. ..... 417/259; 417/545; 417/555.1

[58] Field of Search ..... 417/259, 545, 417/555.1

[56] References Cited

U.S. PATENT DOCUMENTS 4,787,823 11/1988 Hultman ..... 417/45
4,832,578 5/1989 Putt ..... 417/418

FOREIGN PATENT DOCUMENTS 1069802 1/1953 France ..... 417/418

*Primary Examiner*—Timothy S. Thorpe
*Assistant Examiner*—Cheryl J. Tyler

[57] ABSTRACT

A two stage compressor or pump with integral electronically controlled multiphase linear motor incorporates a cup shaped moving piston as a stator. The linear motor body has an intake head with valve fitted at the end adjacent to the closed end of the cup shaped piston. A discharge head with a central discharge tube extending into the hollow center of the cup shaped moving piston is fitted to the opposite end of the motor body. As the piston reciprocates it draws the working fluid in through the intake valve, compresses and transfers it through an interstage valve in the closed end of the moving piston into a second variable volume chamber formed by the inside of the cup shaped piston and the discharge tube which acts as a fixed piston, and then further compresses and transfers it out through a valve in the discharge tube. While the design is particularly well suited for use as a compressor in air conditioning and refrigeration systems, it can also be used as a pump.

12 Claims, 4 Drawing Sheets

LINEAR COMPRESSOR OR PUMP WITH INTEGRAL MOTOR

This application claims benefit of Provisional Appln. 60/017,006 filed Apr. 30, 1996.

FIELD OF THE INVENTION

The present invention pertains to the field of mechanical devices for the pumping of fluids which are powered by an integral linear electric motor.

BACKGROUND OF THE INVENTION

While linear motor based compressors and pumps offer certain theoretical advantages such as mechanical simplicity and reduced friction relative to traditional reciprocating machines, there are numerous design challenges unique to linear compressors which must be addressed in order to make them a practical alternative in the general market. U.S. Pat. No. 4,965,864 by Roth and Roth addresses key issues such as magnetic circuitry and control logic which are applicable to a wide range of motor, pump and compressor applications. Linear motors of this type are properly referred to as tubular motors in that the drive coils are arranged so as to form a cylinder or tube through which the stator is axially driven. Further research has led to designs particularly well adapted to compressor applications, especially those in which flow demand and pressure ratios vary widely and independently as they do in air conditioning and refrigeration systems. Most linear compressors now available rely on a single phase electrical design which produces force only through a limited distance and in a single direction with return force provided by a mechanical spring. Examples of this design include U.S. Pat. No. 5,342,176 to Redlich and 5,261,799 to Laskaris. They do not scale well above fractional horsepower sizes and speed is fixed by mechanical resonance. These linear compressors show promise for household refrigerator applications but may not be suitable for air conditioning applications. Traditionally, air conditioning compressors have been designed so that their narrow peak efficiency curve matches the expected peak pressure and flow requirements for the system in which they are to be installed. This leads to a situation in which manufacturers find it necessary to offer a large number of nearly energy loss because the compressor will spend the majority of it's operating hours working well below capacity in the lower regions of it's efficiency curve. At the same time, if peak design conditions are exceeded the compressor may fail catastrophically. For this reason systems are often oversized, further reducing their efficiency. Some of the highest efficiency residential and light commercial air conditioning systems available today rely on two compressors in parallel which can be brought on line independently as conditions warrant. As a result these systems are bulky, complex, and expensive.

While oil free operation is beneficial in an air conditioning compressor, in some applications, such as oxygen or medical compressed air, it is required. While linear compressors have a sliding piston, the transverse force created in the process of changing the rotary motion of the motor into the reciprocating motion required by the piston has been eliminated. Early models of linear compressor have demonstrated reliable oil free operation. Other applications for pumps and compressors require metering of the working fluid. This is typically done with external sensors, but with a positive displacement pump or compressor it can be done internally by monitoring strokes.

OBJECTS OF THE INVENTION

It is therefore the object of the present invention to provide a compressor capable of operating efficiently over a wide range of independently varying pressure and flow conditions.

It is also an object of the present invention to provide a rugged and mechanically simple compressor or pump with few moving parts.

It is also an object of the present invention to provide a reciprocating compressor or pump whose stroke length and speed can be varied independently while in operation.

It is also an object of the present invention to provide a compressor which can be used as a retrofit for a large number of different models of conventional compressors.

It is also an object of the present invention to provide a compressor or pump which is adaptable to a wide range of working fluids.

It is also an object of the present invention to provide a compressor or pump which can be used as a virtual sensor to provide information on the pressure, flow, temperature and other properties of the working fluid.

It is also an object of the present invention to provide a compressor capable of operating reliably with a minimum of lubrication.

SUMMARY OF THE INVENTION

The invention is based on a multiphase, electronically controlled tubular electric motor with a cup shaped stator. By multiphase is meant that the electric motor comprises a plurality of drive coils sequentially excited to produce force on the stator. The current provided to the motor by the control circuitry is multiphase even though the current provided to the control circuitry may be single phase or even direct current. As used herein, stator means that part of the electric motor which is magnetically passive, or not supplied with external electric current. In this design the stator is the moving part, in the shape of a hollow cylinder closed at one end (cup shaped) and having a one way valve in the closed end of the cylinder herein referred to as the interstage valve. This stator acts as a moving piston on it's outer diameter and as a moving cylinder on it's inner diameter. A hollow cylinder or discharge tube acts as a fixed piston working in this moving cylinder. A discharge valve may be fitted at the end of this central cylinder for compressor applications. As the stator reciprocates the working fluid is drawn in through the intake valve, compressed and transferred through the interstage valve, and forced out through the central cylinder.

DETAILED DESCRIPTION OF THE PRESENT INVENTION

Figure 1:
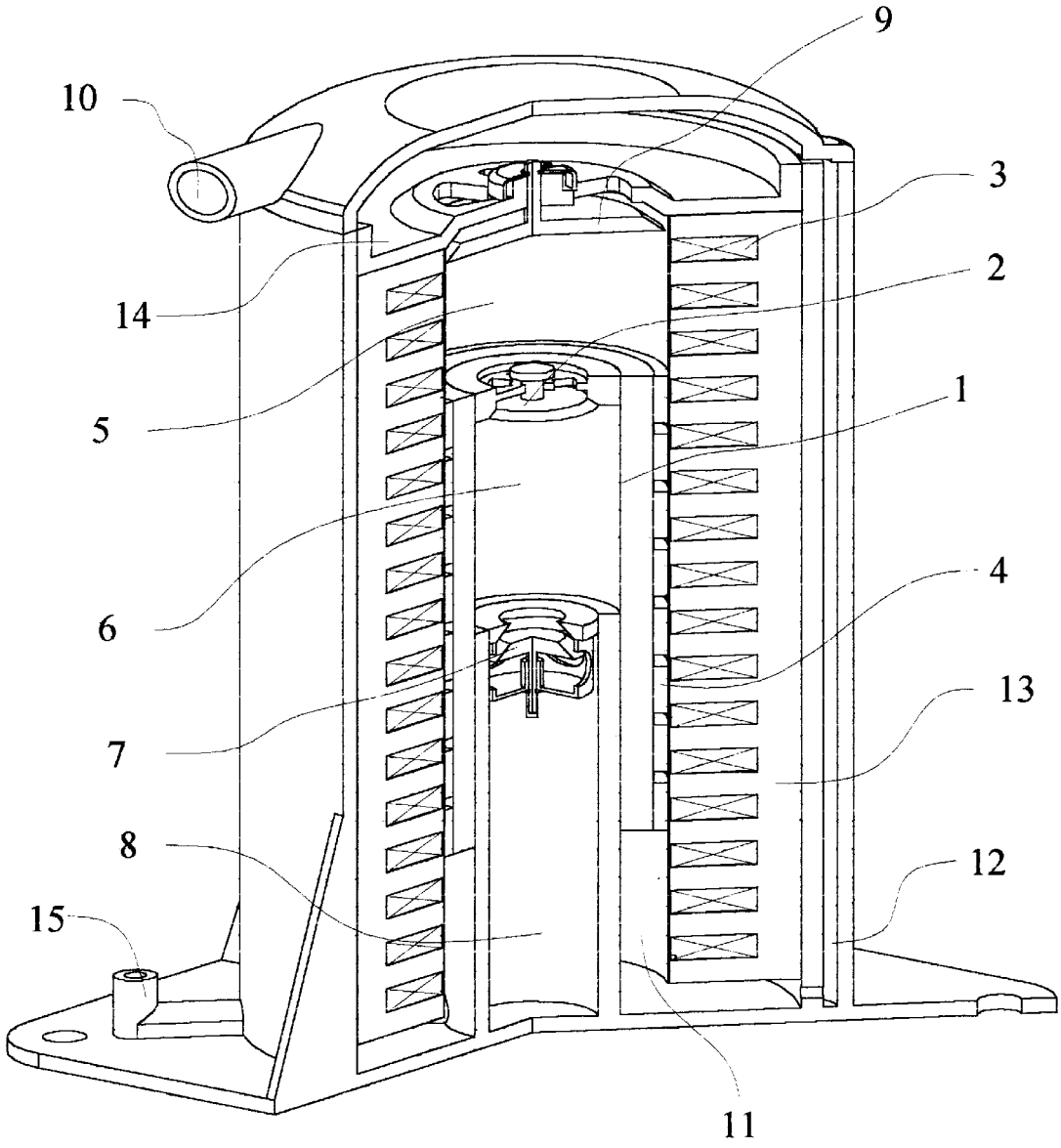
FIG. 1 is a partial sectional view of a linear compressor suitable for air conditioning applications based on the present invention.

FIG. 1 shows a partial sectional view of a two stage linear compressor near the beginning of the interstage stroke. A cup shaped piston 1 having an interstage valve 2 in it's base is driven by electronically controlled drive coils 3 interacting with radially oriented permanent magnets 4 as further described in our U.S. Pat. No. 4,965,864. While permanent magnets are shown in this embodiment it is to be understood that the linear motor could also be constructed as a reluctance or inductance machine. As the piston 1 reciprocates it moves working fluid through the interstage valve 2 from the intake chamber 5 to the discharge chamber 6 and through the discharge valve 7 to the discharge port 15. At the same time fluid is drawn in through the intake valve 9 from the intake port 10. The annular chamber 11 is connected to the intake port 10 through a balance port 12. While the design shown in these drawings is circular in cross section it is understood that oval or other shapes could be used. The drive coils 3 and ferromagnetic material 13, which may comprise either steel laminations or ferrite material as is well understood in the art, form a tubular motor body having a hollow center in which the moving piston 1 reciprocates. This hollow center is sealed at one end by an intake head comprising an intake port 10 an intake valve 9 and a valve support plate 14. It is sealed at the opposite end by a discharge head comprising a discharge port 15, discharge valve 7 and discharge tube 8.

Figure 2:
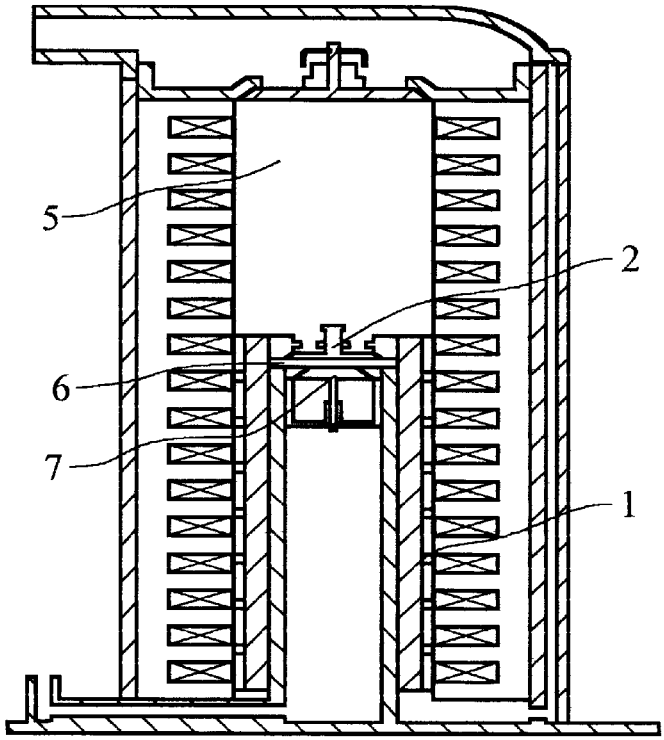
FIGS. 2 through 5 are sectional views showing piston and valve operation during a typical cycle.

FIG. 2 shows the piston 1 prior to the beginning of the interstage stroke with the interstage 2 and discharge 7 valves at closest proximity. All valves are closed and the intake cylinder 5 is at maximum volume and filled with working fluid.

Figure 3:
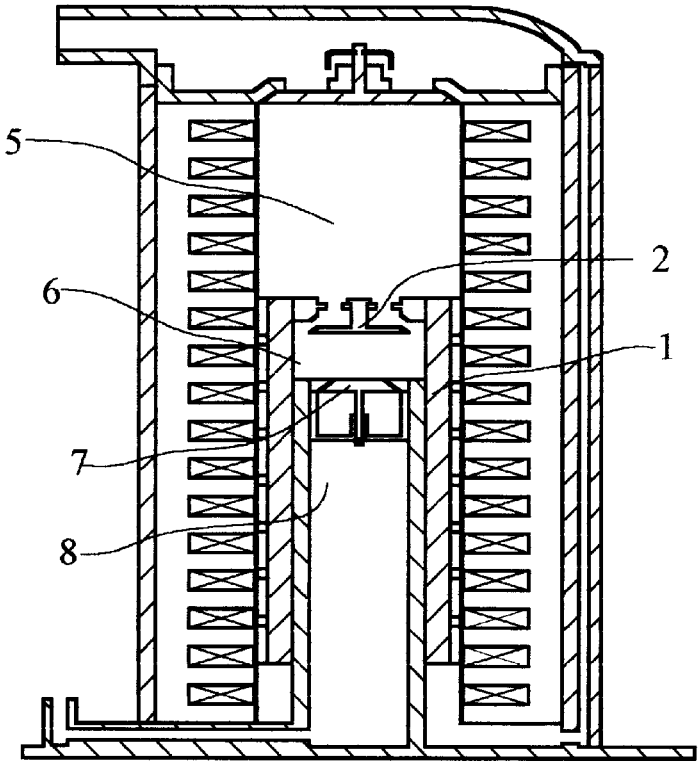

FIG. 3 shows the beginning of the interstage stroke. As the piston 1 moves upward in this embodiment the working fluid is compressed and transferred from the large intake chamber 5 through the interstage valve 2 into the smaller discharge chamber 6 formed by the interior of the cup shaped piston 1 and the discharge valve 7 on the end of the discharge tube 8.

Figure 4:
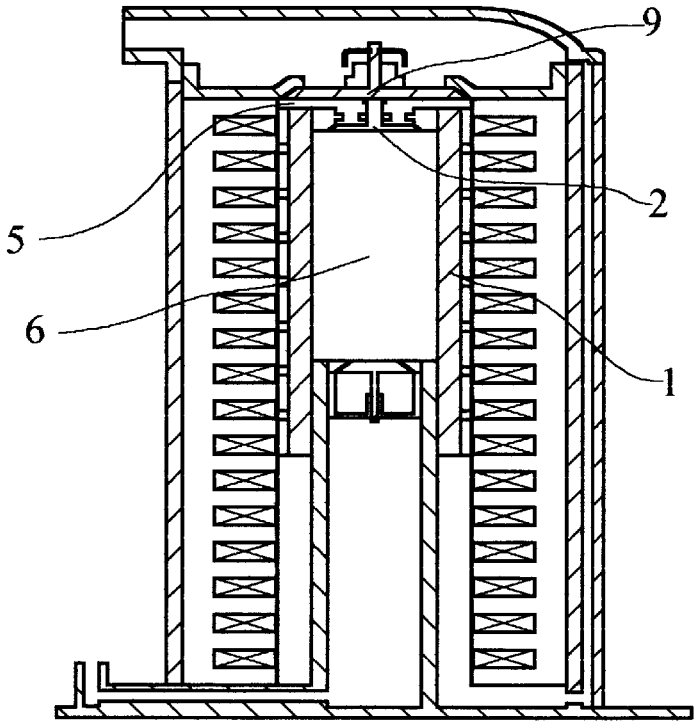

FIG. 4 shows the end of the interstage stroke and prior to the beginning of the flow stroke. The interstage 2 and intake 9 valves are at closest proximity. The intake chamber 5 is at minimum volume while the discharge chamber 6 is at maximum volume. All valves are closed and the direction of motion is reversed.

Figure 5:
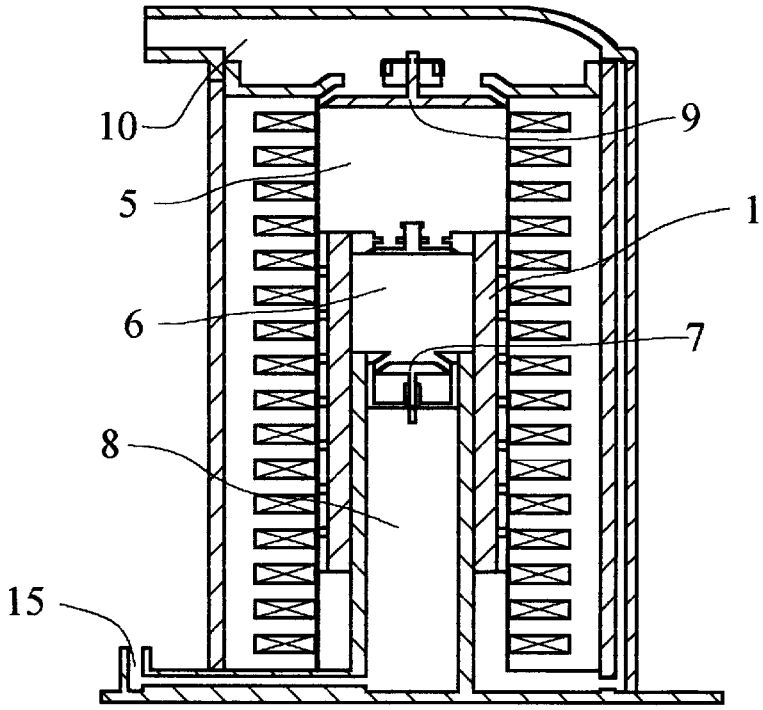

FIG. 5 shows the flow stroke. As the piston 1 moves downward the intake valve 9 opens and a fresh charge of working fluid is drawn in through the intake port 10. When the pressure in the discharge chamber 6 is greater than that in the discharge tube 8 the discharge valve 7 opens and the original charge of working fluid is compressed and transferred out of the compressor through the discharge port 15. At the end of the flow stroke all valves close and the cycle repeats.

Figure 6:
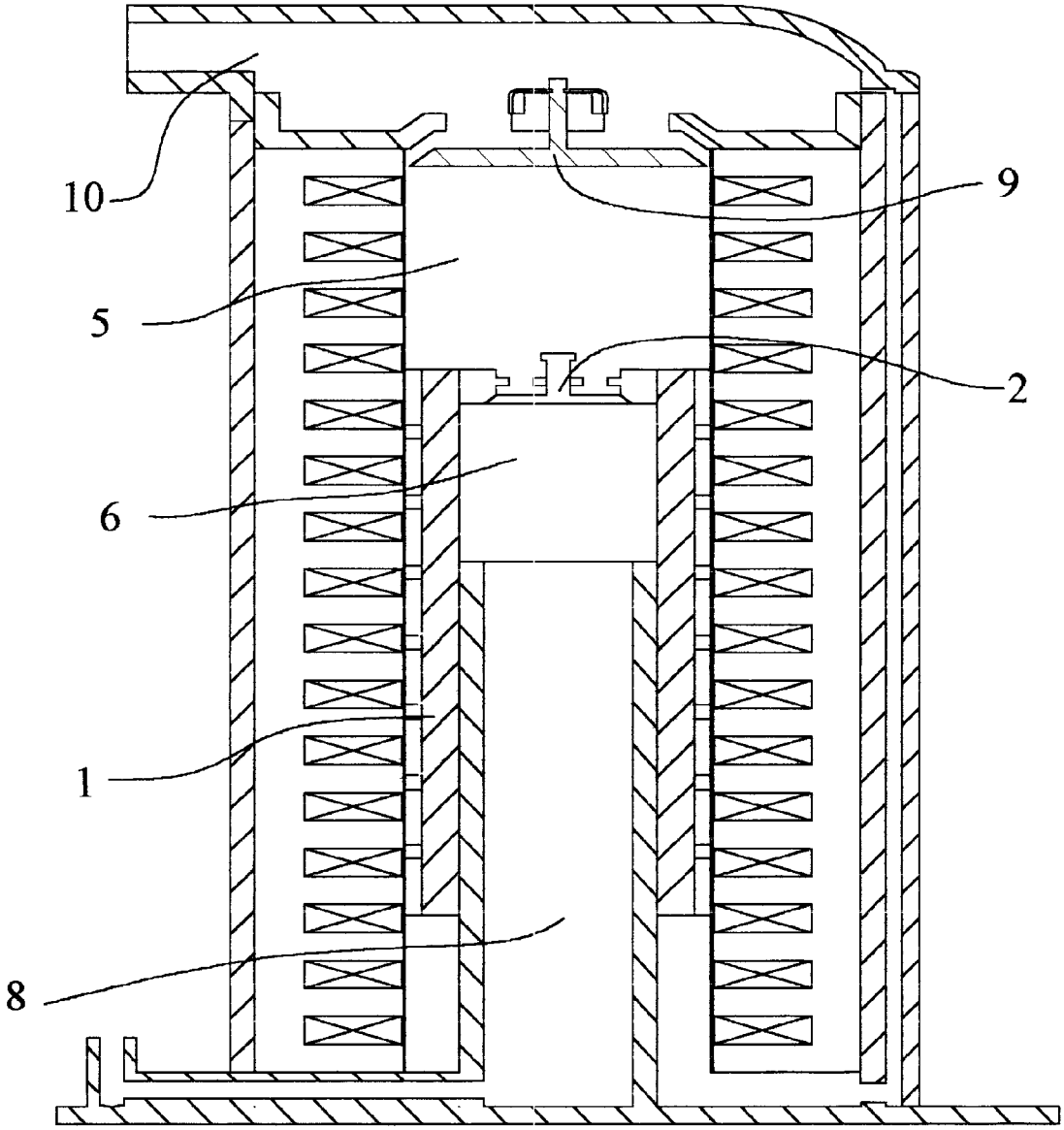
FIG. 6 is a sectional view of a pump suitable for non-compressible fluids

FIG. 6 shows a pump based on the present invention. Since the intake valve 9 prevents backflow during the interstage stroke, no discharge valve is needed, and the discharge tube 8 is left open.

A third variable volume chamber 11 is defined by the annular space around the discharge tube 8 and the skirt of the cup shaped piston 1. A balance port 12 connects this annular chamber 11 to the intake port 10 In most cases the balance port 12 would be left open to balance force requirements in both directions of stroke, but it would be possible to provide a valve along this port to enhance certain aspects of performance such as high pressure operation. It may also be possible to increase efficiency by creating a venturi whereby working fluid forced out through the balance port 12 could be used to enhance flow through the intake port 10. For pump applications the annular chamber 11 could be ported to atmosphere.

Both the intake valve 9 and interstage valve 2 operate as inertia valves, i.e. the natural reaction forces of normal operation tend to open and close them at the appropriate time during the cycle. The use of an "electronic cam" to control piston acceleration allows for quiet valve operation by minimizing piston acceleration at the moment of valve closure. The discharge valve 7 is also inertia operated at closure, but is pressure operated on opening and under low pressure differential operation may open during the interstage stroke when pressure in the discharge cylinder 6 exceeds that in the discharge tube 8. Little or no valve springing is needed for operation.

The large diameter of the intake chamber 5 allows correspondingly large valve ports to reduce wire drawing and improve flow efficiency. The interstage valve 2 and discharge valve 7 can also use the full diameter of their respective cylinders. When the working fluid is essentially non-compressible only two valves are needed, and either the intake 9 or discharge 7 valve may be left off. Since the discharge valve 7 is of smaller size and may present a flow restriction it may be advantageously eliminated.

In the current invention there are two separate bore diameters. The large intake chamber volume 5 allows for large displacement and high flow rates while the small diameter of the discharge chamber 6 allows for high pressure operation. Stroke length and speed in both directions is electronically controlled and dynamically variable, allowing for a smooth transition from high flow to high volume operation. While the absolute pressure and flow ranges are still determined by the chamber diameters and maximum stroke length, the range of operation is greatly increased relative to other designs. When pressure differentials are high, available motor force may be insufficient to drive the piston 1 to the maximum length of the interstage stroke. In this case the interstage stroke may be shortened, thereby reducing volumetric flow, without seriously affecting mass flow. The working fluid remaining in the intake chamber 5 then acts as a gas spring to help compress the working fluid in the discharge chamber 6.

Available force or torque in an electric motor is a function of the active magnetic area of the air gap and the magnetic flux density in the air gap. The available magnetic area in a tubular linear motor is $2\pi rL$ where r is piston radius and L is piston length. Intake cylinder bore area is $\pi r^2$. Since the diameter of the piston affects both the intake cylinder bore area and the active magnetic area in the same way for a given piston aspect ratio (length to diameter) the compressor is relatively insensitive to scale. Available force is also a function of magnetic gap flux density. Optimization of magnetic circuitry involves a number of factors. The magnetic gap should be as short as possible. Since this gap also must contain the cylinder liner, seals, and clearance, design and materials challenges exist. Flux densities within the piston create another problem, as the gap flux passes through this constrained volume to return to the radially oriented gap. The thickness of the ferromagnetic material required to carry this flux presents a design constraint on the ratio between intake and discharge cylinder diameters. While the design shown indicates the magnetic back iron incorporated into the piston, it is also possible to use the discharge tube as a flux carrier. This would allow closer matching of the intake and discharge chamber diameters in applications where this was desirable.

The motor force used to produce compression is essentially linear and equal in both directions of stroke. It must be sufficient to both compress the refrigerant and accelerate the piston at a rate adequate to maintain required flow rate. With low intake pressures the compressor will operate at full stroke to produce maximum volume flow rate. At high intake pressures stroke is limited by available motor force and volume flow will be decreased although mass flow may be greater. For pump applications involving fixed volume fluids or liquids, a ratio of intake cylinder radius to discharge cylinder radius of √2/1 will provide equal volume pumping in both directions and the discharge valve becomes optional. For compressor applications higher ratios will provide a larger first stage and smaller second stage compression chamber.

I claim:

1. A two stage compressor with integral multiphase linear electric motor comprising:

a) a plurality of substantially similar electrically conductive drive coils axially arranged, said drive coils externally surrounded with a first magnetic flux carrying means, said drive coils together with said flux carrying means forming a hollow cylindrical motor body b) a hollow cylindrical piston slideably positioned within said motor body, said piston furnished with a second magnetic flux carrying means integral with at least a radially outer surface thereof c) piston closure means with a one way interstage valve provided at one end of said hollow cylindrical piston d) a first motor body closure means with a one way intake valve provided at a first end of said motor body adjacent to said interstage valve in said piston e) a second motor body closure means provided at a second end of said motor body adjacent to the open end of said hollow piston, said second motor body closure means provided with a salient discharge tube with a one way discharge valve extending slideably into the hollow bore of said piston whereby, as said piston oscillates within said motor body in response to sequential electrical currents flowing in said drive coils, a working fluid is drawn into said compressor through said intake valve and is compressed and transferred through said interstage valve into the hollow center of said piston in a first stage of compression, and further is compressed and transferred out of said compressor through said discharge tube.

2. The compressor of claim 1 and wherein said first flux carrying means surrounding said drive coils comprises steel laminations.

3. The compressor of claim 1 and wherein said first flux carrying means surrounding said drive coils comprises ferrite material.

4. The compressor of claim 1 and wherein said second flux carrying means on said piston comprises radially oriented permanent magnets.

5. The compressor of claim 1 and wherein said second flux carrying means on said piston comprises ferromagnetic material with radially extending salients.

6. The compressor of claim 1 and wherein said second flux carrying means on said piston comprises electrically conductive rings embedded in ferromagnetic material.

7. A double acting pump with integral multiphase linear electric motor comprising:

a) a plurality of substantially similar electrically conductive drive coils axially arranged, said drive coils externally surrounded with a first magnetic flux carrying means, said drive coils together with said flux carrying means forming a hollow cylindrical motor body b) a hollow cylindrical piston slideably positioned within said motor body, said piston furnished with a second magnetic flux carrying means integral with at least a radially outer surface thereof c) piston closure means with a one way interstage valve provided at one end of said hollow cylindrical piston d) a first motor body closure means with a one way intake valve provided at a first end of said motor body adjacent to said interstage valve in said piston e) a second motor body closure means provided at a second end of said motor body adjacent to the open end of said hollow piston, said second motor body closure means provided with an open salient discharge tube extending slideably into the hollow bore of said piston whereby, as said piston oscillates within said motor body in response to sequential electrical currents flowing in said drive coils, a working fluid is drawn into said pump through said intake valve and is transferred through said interstage valve, through the hollow center of said piston, and out of said pump through said discharge tube.

8. The pump of claim 7 and wherein said first flux carrying means surrounding said drive coils comprises steel laminations.

9. The pump of claim 7 and wherein said first flux carrying means surrounding said drive coils comprises ferrite material.

10. The pump of claim 7 and wherein said second flux carrying means on said piston comprises radially oriented permanent magnets.

11. The pump of claim 7 and wherein said second flux carrying means on said piston comprises ferromagnetic material with radially extending salients.

12. The pump of claim 7 and wherein said second flux carrying means on said piston comprises electrically conductive rings embedded in ferromagnetic material.

* * * * *